US010468857B1

(12) United States Patent
Hwang et al.

(10) Patent No.: US 10,468,857 B1
(45) Date of Patent: Nov. 5, 2019

(54) GROUND ELECTRODE ASSEMBLY FOR A SPARK PLUG

(71) Applicants: DENSO International America, Inc., Southfield, MI (US); DENSO CORPORATION, Kariya, Aichi-pref. (JP)

(72) Inventors: Jeongung Hwang, Northville, MI (US); Christopher Thomas, Berkley, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 16/025,210

(22) Filed: Jul. 2, 2018

(51) Int. Cl.

| | |
|---|---|
| ***H01T 13/32*** | (2006.01) |
| ***H01T 21/02*** | (2006.01) |
| ***C23C 4/18*** | (2006.01) |
| ***C23C 4/06*** | (2016.01) |

(52) U.S. Cl.
CPC ..... *H01T 13/32* (2013.01); *C23C 4/06* (2013.01); *C23C 4/18* (2013.01); *H01T 21/02* (2013.01)

(58) Field of Classification Search
CPC ... B60Q 3/74; B60Q 3/51; B60Q 3/64; B60Q 3/12; F21W 2106/00; F21S 43/31; F21S 43/14; F21S 43/19
See application file for complete search history.

(56) References Cited

U.S. PATENT DOCUMENTS

| | | | | |
|---|---|---|---|---|
| 5,408,961 | A * | 4/1995 | Smith | H01T 13/32 123/169 EL |
| 7,045,939 | B2 | 5/2006 | Teramura et al. | |
| 7,557,495 | B2 | 7/2009 | Tinwell | |
| 9,929,542 | B2 * | 3/2018 | Araya | H01T 13/32 |
| 9,948,070 | B2 * | 4/2018 | Kawade | H01T 13/06 |
| 2010/0213812 | A1 * | 8/2010 | Kawashima | B23K 9/0026 313/141 |
| 2011/0316408 | A1 * | 12/2011 | Suzuki | H01T 13/20 313/141 |
| 2018/0331508 | A1 * | 11/2018 | Hwang | H01T 13/32 |

FOREIGN PATENT DOCUMENTS

JP 2004079507 A 3/2004

* cited by examiner

*Primary Examiner* — Tracie Y Green
(74) *Attorney, Agent, or Firm* — Harness, Dickey & Pierce, P.L.C.

(57) ABSTRACT

A spark plug includes a housing, a center electrode, and a ground electrode assembly. The center electrode is disposed within the housing. The ground electrode assembly cooperates with the center electrode to generate a spark. The ground electrode assembly further includes an arm, a ground electrode, and a ground electrode pad. The arm is fixed to the housing. The ground electrode is disposed opposite the center electrode. The ground electrode pad is disposed on an inner surface of the ground electrode. The ground electrode pad is a precious metal coating on the surface of the inner surface.

10 Claims, 4 Drawing Sheets

FIG - 3D
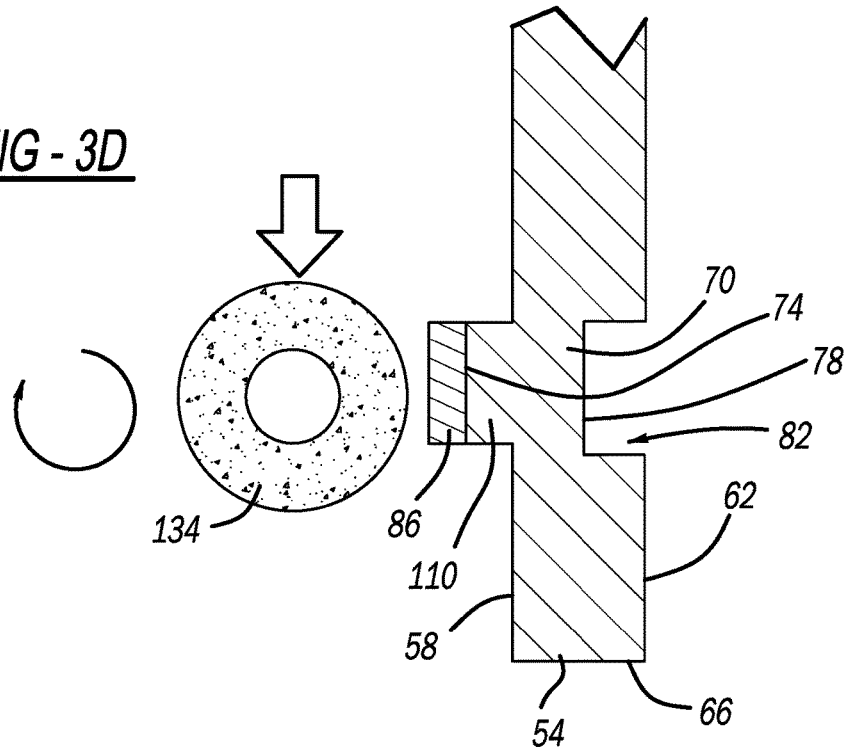
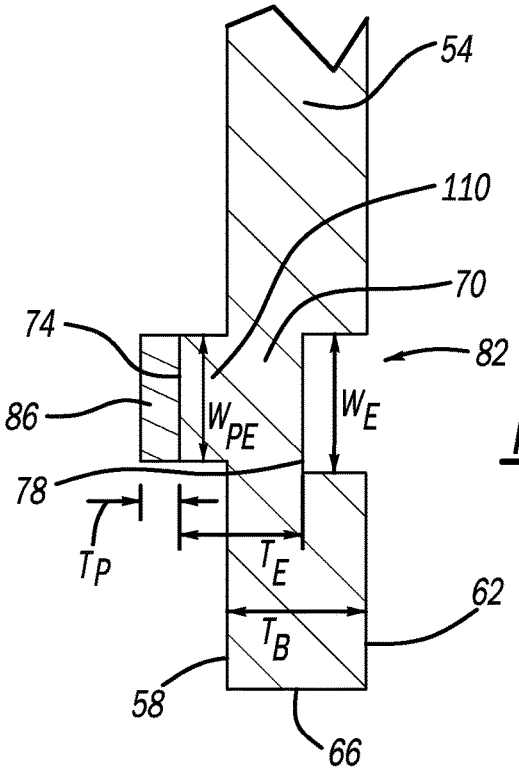
FIG - 3E

GROUND ELECTRODE ASSEMBLY FOR A SPARK PLUG

FIELD

The present disclosure relates to spark plugs, and, specifically, to a thermal-spray-coated, long-life, high-ignitability spark plug.

BACKGROUND

This section provides background information related to the present disclosure which is not necessarily prior art.

Spark plugs often include a housing having a copper core and center electrode disposed within. A ground electrode base extends from the housing and may include a ground electrode pad on its tip. A gap exists between the ground electrode pad, or ground electrode base and the center electrode. Spark plugs work by generating a high potential difference between the center electrode and the ground electrode pad or ground electrode base. When the potential difference gets high enough, a spark is formed which ignites a fuel-air mixture.

Standard spark plugs without precious metal on the ground electrode base or ground electrode pad may suffer from accelerated ground electrode erosion in today's advanced combustion environments. Improvements have been made such as adding precious metal pads in place of ground electrode pads on the ground electrode base to suppress wear. However, the longevity provided by this method is not accompanied by an ignitability improvement.

SUMMARY

This section provides a general summary of the disclosure, and is not a comprehensive disclosure of its full scope or all of its features.

An example spark plug according to the present disclosure includes a housing, a center electrode, and a ground electrode assembly. The center electrode is disposed within the housing. The ground electrode assembly cooperates with the center electrode to generate a spark. The ground electrode assembly further includes an arm, a ground electrode, and a ground electrode pad. The arm is fixed to the housing. The ground electrode is disposed opposite the center electrode. The ground electrode pad is disposed on an inner surface of the ground electrode. The ground electrode pad is a precious metal coating on the surface of the inner surface.

The thickness of the arm may be equal to the thickness of the ground electrode.

The thickness of the ground electrode pad may be less than the thickness of the ground electrode.

The precious metal coating may be an alloy containing iridium or platinum.

The ground electrode pad may have a higher conductivity than the arm.

An example for a ground electrode assembly for a spark plug according to the present disclosure may include an arm, a ground electrode, and a ground electrode pad. The ground electrode may be disposed on the arm. The ground electrode may include a protrusion on a first surface of the arm and a recess on a second surface of the arm. The ground electrode pad may be disposed on a surface of the ground electrode. The ground electrode pad may be a thermal coating on the surface of the ground electrode.

A thickness of the arm may be equal to a thickness of the ground electrode.

A thickness of the ground electrode pad may be less than a thickness of the ground electrode.

The thermal coating may be a precious metal coating containing iridium or platinum.

The ground electrode pad may have a higher conductivity than the arm.

An example method of manufacturing a ground electrode assembly according to the present disclosure may include: punching, using a punch and die, a ground electrode in an arm; spraying, using a spray nozzle, a thermal coating on a surface of said ground electrode; and refining, using a material modification tool, a shape of said thermal coating.

The method may further include punching, using the punch and die, a protrusion in an inner surface and a recessed in an outer surface of the arm to form the ground electrode.

The method may further include grinding, using a grinder, the thermal coating to refine the shape of the thermal coating.

The method may further include spraying, using the spray nozzle, a precious metal as the thermal coating on the surface of the ground electrode.

The method may further include spraying, using the spray nozzle, an alloy containing iridium or platinum as the thermal coating on the surface of the ground electrode.

The method may further include protecting, using a plurality of guide plates, an inner surface of the arm surrounding the ground electrode from the thermal coating applied by spraying.

The method may further include engaging the plurality of guide plates with the inner surface of the arm.

The method may further include bending, using a tool, the arm after fixing the arm to a housing of a spark plug.

The method may further include fixing the arm to the housing by welding.

The method may further include engaging the punch with an outer surface of the arm and engaging the die with an inner surface of the arm.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIGS. 3A-3E are illustrations showing a method of forming a ground electrode assembly according to the present disclosure.

Corresponding reference numerals indicate corresponding parts throughout the several views of the drawings.

DETAILED DESCRIPTION

Figure 1:
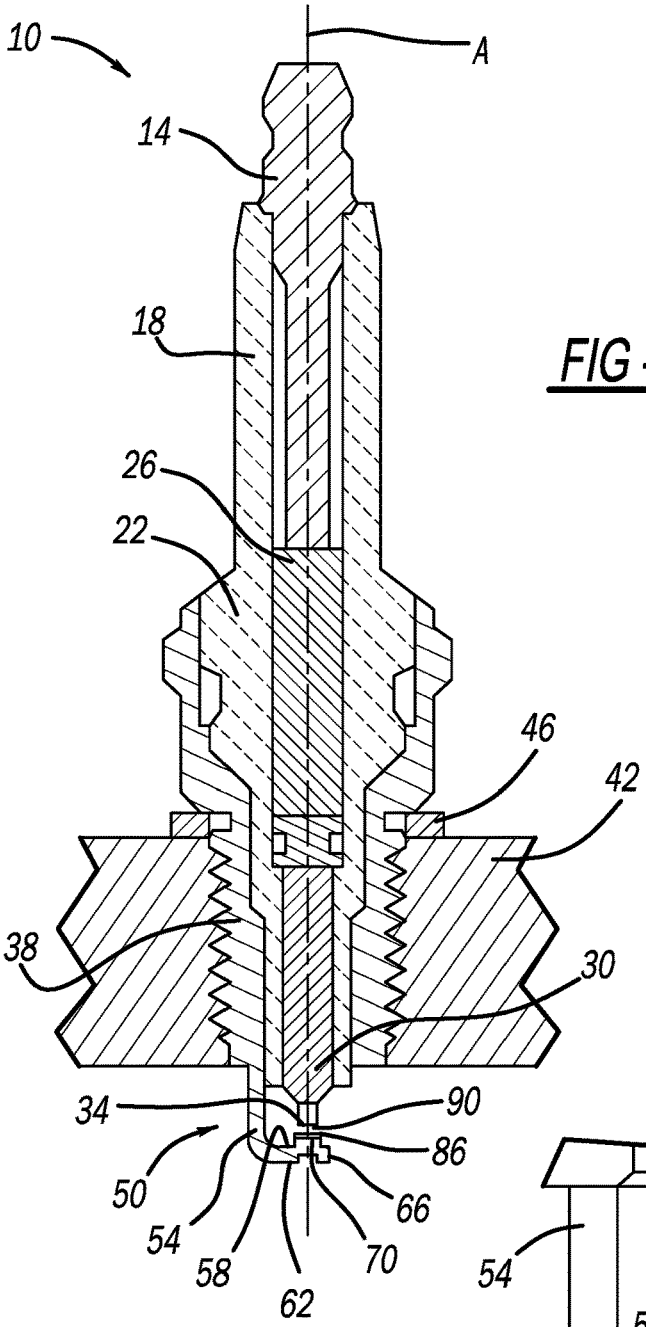
FIG. 1 is a spark plug according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure relates to a spark plug having improved ignitability through use of a punched-up ground electrode, which allows more area for flame kernel development. The spark plug of the present disclosure has an increased lifetime using precious metal thermal spray coating on the punched-up ground electrode. A precious metal cost reduction exists through using the thermal spray coating on the punched-up ground electrode instead of a precious metal pad (for example, an Iridium pad or a Platinum pad).

The spark plug of the present disclosure achieves these benefits by utilizing a die and punch during manufacture of the ground electrode base for the spark plug to punch a raised ground electrode in the ground electrode base. A guide plate is then utilized to apply a precious metal thermal spray coating to a top surface of the raised ground electrode, creating a precious metal ground electrode pad. The coating is then ground to achieve the desired profile shape for the ground electrode pad.

Now referring to FIG. 1, a spark plug 10 in accordance with the present teachings is illustrated. The spark plug 10 can be any suitable spark plug for use with any suitable engine. For example, the engine may be any suitable vehicle engine. The vehicle engine may be for a passenger vehicle, mass transit vehicle, military vehicle, construction vehicle, aircraft, watercraft, etc. The spark plug may also be used with non-vehicular engines, such as generator engines or engines for other machinery, systems, equipment, etc.

The spark plug 10 generally includes a terminal 14 surrounded by an insulator 18, which includes an inside housing portion 22. The terminal 14 extends along a longitudinal axis A of the spark plug 10 to a glass seal 26. Also extending along the longitudinal axis A is a center electrode 30, which has a center electrode tip 34. The longitudinal axis A extends generally through a center of the tip 34. Surrounding the center electrode 30 is a housing 38. The housing 38 is configured to be mounted to an engine head 42 in any suitable manner. The engine head 42 can be an engine head of any suitable engine. Extending around the housing 38 is a gasket 46.

Figure 2:
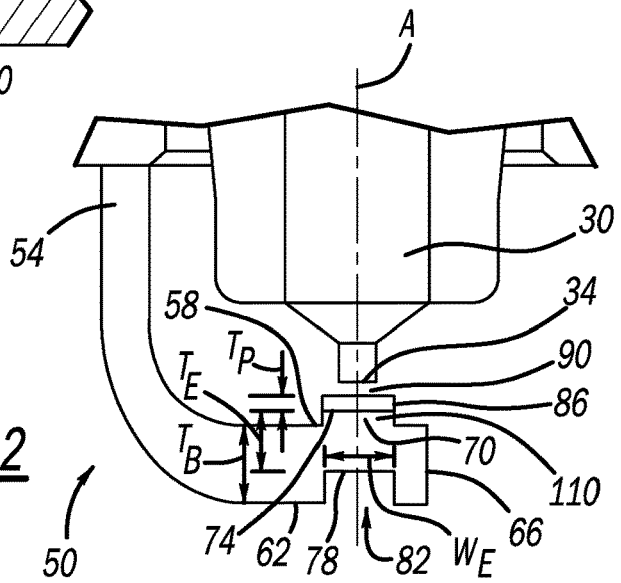
FIG. 2 is a detailed view of the spark plug of FIG. 1.

With continued reference to FIG. 1, and additional reference to FIG. 2, the spark plug 10 further includes a spark plug ground electrode assembly 50, which has a ground electrode arm, or base, 54 according to the present disclosure. The ground electrode base 54 includes an inner surface 58, an outer surface 62, and an end surface 66. The inner surface 58 faces the center electrode 30, and the outer surface 62 is opposite the inner surface 58. The ground electrode base 54 can be made of any suitable material, such as a nickel alloy.

A ground electrode 70 is formed near the end surface 66 of the ground electrode base 54. The ground electrode 70 may be formed during the manufacturing process of the ground electrode base 54, as further described below. The ground electrode 70 may be defined by a raised, or stepped, inner surface 74 that extends closer to the center electrode 30 than the inner surface 58 and a depressed, or stepped, outer surface 78 that forms a recess 82 in the outer surface 62. The inner surface 74 and the outer surface 78 of the ground electrode 70 may be offset from the inner surface 58 and outer surface 62 of the ground electrode base 54, such that a thickness $T_E$ of the ground electrode 70 is the same as a thickness $T_B$ of the ground electrode base 54, but the inner surface 74 of the ground electrode 70 is disposed closer to the center electrode 30 than the inner surface 58 of the ground electrode base 54. For example only, the thickness $T_E$ and the thickness $T_B$ may both be approximately 1.5 to 2.0 millimeters (mm). In some circumstances, the thickness $T_E$ may be smaller than the thickness $T_B$ due to material compression during the formation of the ground electrode 70.

A ground electrode pad 86 may be disposed on the inner surface 74 of the ground electrode 70. The ground electrode pad 86 may have a thickness $T_P$ that is less than both the thickness $T_E$ and the thickness $T_B$. For example only, the thickness $T_P$ may be approximately 0.2 to 2.0 mm total to prevent the ground electrode pad 86 from detaching from the ground electrode 70. The ground electrode pad 86 may be formed of a precious metal, for example iridium, platinum, or any other precious metal, to increase the lifespan of the spark plug 10. The ground electrode pad 86 may be a sprayed coating formed on the inner surface 74 of the ground electrode 70 during the manufacturing process of the ground electrode base 54, as further described below.

A gap 90 exists between the ground electrode pad 86 and the center electrode 30. In operation, a high potential difference is generated between the center electrode 30 and the ground electrode pad 86. When the potential difference reaches a breakdown threshold, a spark is formed which ignites a fuel-air mixture within and surrounding the gap 90. The breakdown threshold may be dependent on a number of factors and may be calculated using Paschen's Law:

$$V_b = \frac{B \cdot p \cdot d}{\ln(A \cdot p \cdot d) - \ln\left(\ln\left(1 + \frac{1}{\gamma_{se}}\right)\right)}$$

where B is a constant depending on a surrounding gas (V/atm*m), p is a pressure of the surrounding gas (atm), d is a gap distance (m), A is a constant that depends on the surrounding gas (1/atm*m), and $\gamma_{se}$ is a secondary electron emission coefficient.

Turbulence (either tumble or swirl) may be introduced into the combustion chamber to mix the air and fuel for combustion. A flame kernel 98 is formed between the center electrode 30 and the ground electrode pad 86, leading to combustion of the air-fuel mixture.

Figure 3A:
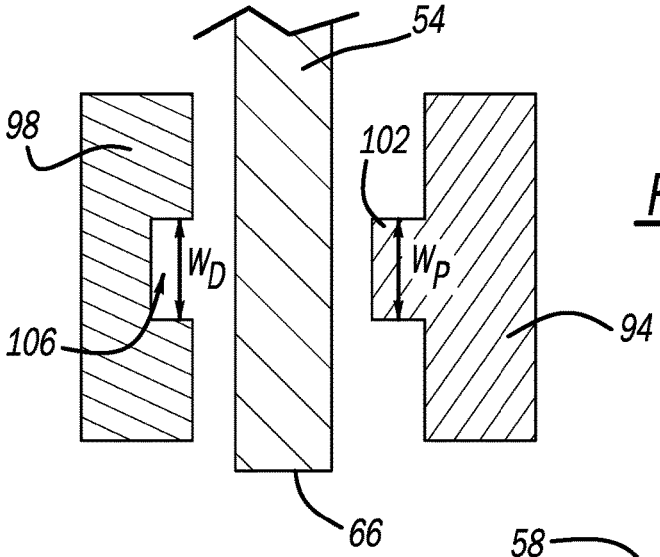

Referring to FIGS. 3A-3E, the ground electrode assembly 50 is manufactured as a straight rod, separately from the remainder of the spark plug 10. As seen in FIG. 3A, the ground electrode base 54 is a straight rod. As previously stated, the ground electrode base 54 may be formed of, for example only, a nickel alloy. A punch 94 and die 98 may be used to form the ground electrode 70 in the ground electrode base 54. The punch 94 may include a protrusion 102 that mates with a recess 106 in the die 98. A width $W_P$ of the punch may be equal to a width $W_E$ of the recess 82 in the outer surface 62 defining the ground electrode 70. Further, the width $W_P$ of the punch may also be equal to a width $W_D$ of the recess 106 in the die 98 and a width $W_{PE}$ of a protrusion 110 of the inner surface 74 defining the ground electrode 70.

Figure 3B:
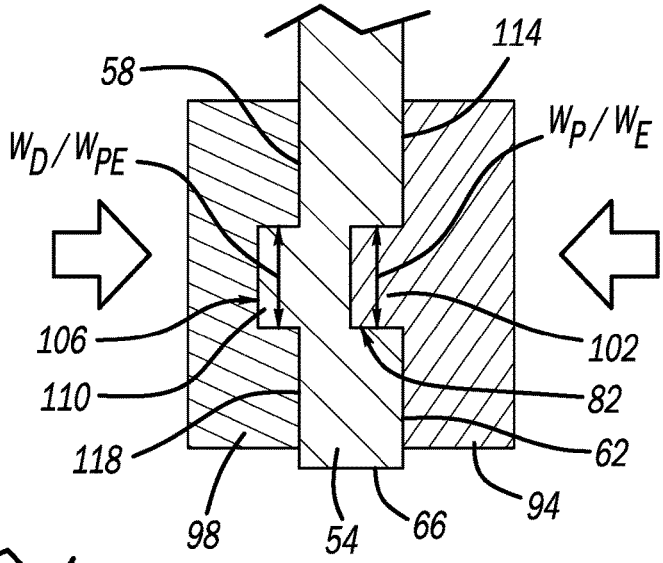

As illustrated in FIG. 3B, the punch 94 and die 98 are pressed together, with a surface 114 of the punch 94 coming into contact with the outer surface 62 and a surface 118 of the die 98 coming into contact with the inner surface 58. As such, the pressing movement of the punch 94 and die 98 deforms the ground electrode base 54 and forms the ground electrode 70. As shown, the protrusion 102 in the punch 94 forms the recess 82 in the outer surface 62. Further, the recess 106 in the die 98 forms the protrusion 110 in the inner surface 58 of the ground electrode base 54. Once the ground electrode 70 is formed, the punch 94 and die 98 are removed from the ground electrode base 54.

Figure 3C:
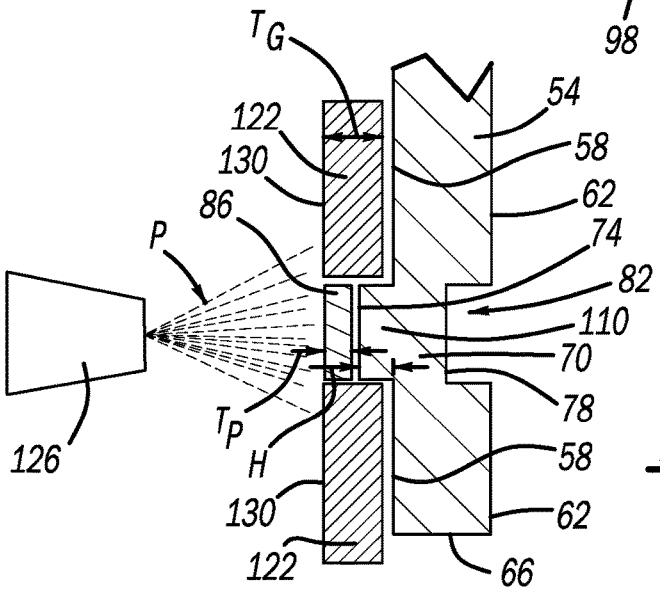

Now referring to FIG. 3C, the ground electrode pad 86 is formed on the inner surface 74 of the ground electrode 70. Guide plates 122 are placed on the inner surface 58 of the electrode base 54 to protect the inner surface 58 from any residual spray. A thickness $T_G$ of the guide plates 122 may be equal to a height H of the inner surface 74 beyond the inner surface 58 plus a desired thickness $T_P$ of the ground electrode pad 86.

The inner surface 74 of the ground electrode 70 may be treated with aluminum powder blasting to create a rough surface for adhesion of the thermal coating. A spray nozzle 126 for administering the thermal coating, or precious metal, may direct a spray path P of the thermal coating, or precious metal, toward the exposed inner surface 74 of the ground electrode 70. The spray nozzle 126 may apply the coating until the ground electrode pad 86 is level with, or slightly beyond, an outer surface 130 of the guide plates 122. Once the ground electrode pad 86 is formed, the spray nozzle 126 and guide plates 122 are removed from the ground electrode base 154.

As previously stated, the guide plates 122 protect the inner surface 58 from any residual spray from the spray nozzle 126. Instead of the spray nozzle 126 spraying thermal, or precious metal, coating on the inner surface 58, the spray nozzle 126, instead, sprays the residual thermal, or precious metal, coating on the outer surface 130 of the guide plates 122. By protecting the inner surface 58 from any residual spray, the inner surface 58 is not likely to serve as a conductor of the spark like it would if the inner surface 58 had bits of the thermal, or precious metal, coating from the residual spray. As such, using the guide plates 122 provides increased efficiency and performance advantages.

The ground electrode pad 86 may, at this stage, be rounded or thicker than the desired thickness $T_P$. As such, with reference to FIG. 3D, a grinding wheel 134 or other tool may be used to refine the shape of the ground electrode pad 86. Testing has shown that a flat surface-shape for the ground electrode pad 86 is more effective than a rounded and unrefined shape. Thus, use of the grinding wheel 134 provides the ground electrode pad 86 with the precise shape and thickness $T_P$ that allow maximum effectiveness.

Once the ground electrode pad 86 is refined, the grinding wheel 134 or other tool is removed from the ground electrode base 54, and the ground electrode base 54 is ready for assembly with the spark plug 10. The finished product of the ground electrode assembly 50 before installation on the spark plug 10 is illustrated in FIG. 3E.

Figure 4A:
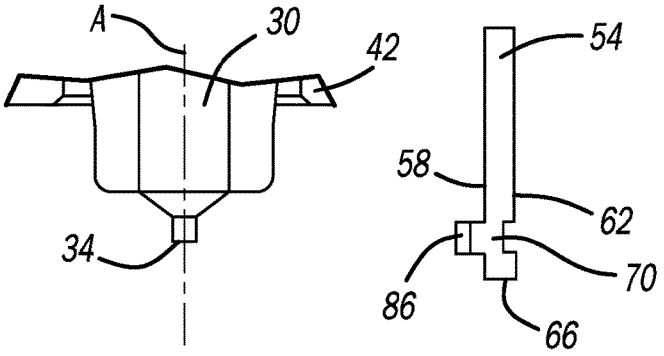
FIGS. 4A-4D are illustrations showing a method of assembling a spark plug.
Figure 4B:
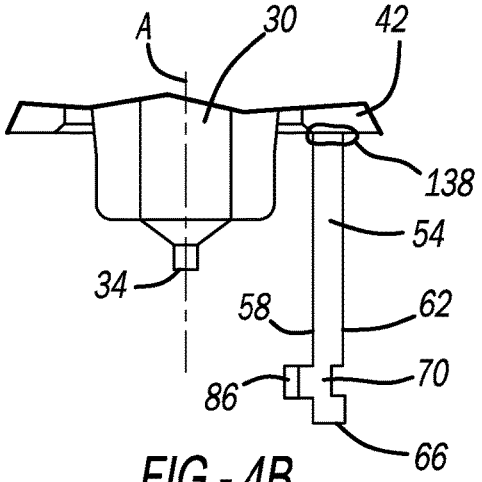

Now referring to FIGS. 4A-4D, once manufacture of the ground electrode assembly 50 is compete, the ground electrode base 54 is fixed to the housing 38 of the spark plug 10. For example, as shown in FIG. 4B, the ground electrode base 54 may be welded 138, or otherwise fixed, to the housing 38 to irremovably secure the ground electrode assembly 50 to the housing 38.

Figure 4C:
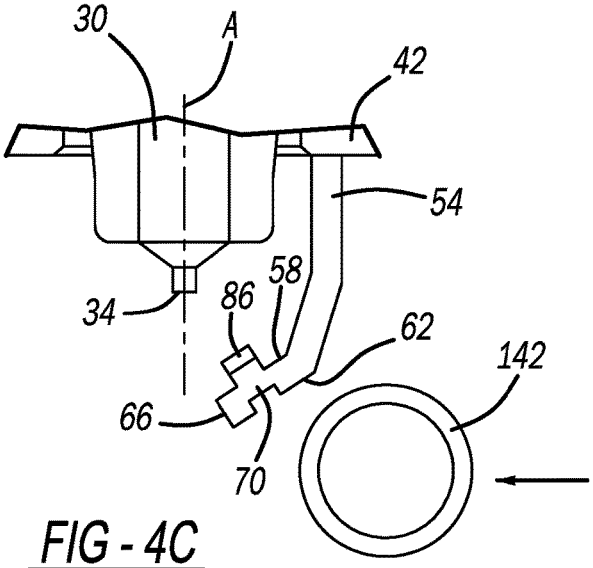

As shown in FIG. 4C, the ground electrode base 54 is bent from the straight beam to a curved beam, such that the ground electrode pad 86 faces the center electrode 30. For example only, a circular die 142 may be used to punch the ground electrode base 54 as illustrated. The ground electrode base 54 must only be bent such that the ground electrode pad 86 is spaced apart from the center electrode 30 by the predetermined gap 90. Improper distance between the center electrode 30 and the ground electrode base 54 will result in decreased, or improper, performance of the spark plug 10.

Figure 4D:
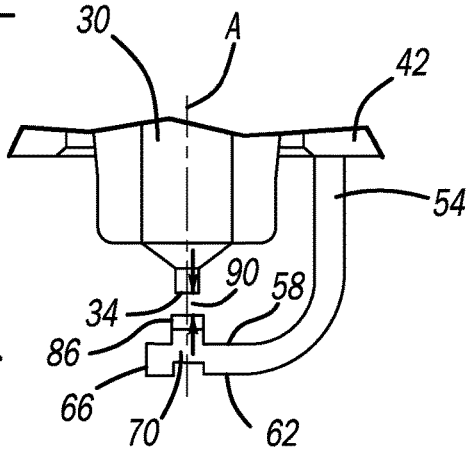

Once the ground electrode base 54 is properly bent, the spark plug 10 is fully assembled as shown in FIG. 4D. The spark plug 10 may now be assembled into the vehicle, or other suitable, engine.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A spark plug comprising:

a housing;

a center electrode disposed within said housing; and a ground electrode assembly cooperating with said center electrode to generate a spark, wherein said ground electrode assembly includes:

an arm fixed to said housing, said arm having an inner surface facing said center electrode and an outer surface opposite said inner surface, a ground electrode disposed opposite said center electrode, said ground electrode defined by a protrusion having a raised surface extending closer to said center electrode than said inner surface of said arm and a depressed outer surface forming a recess in said outer surface of said arm, a width of said protrusion being equal to a width of said recess, and a ground electrode pad disposed only on said raised surface of said ground electrode, said ground electrode pad being a precious metal coating on said raised surface.

2. The spark plug of claim 1, wherein a thickness of said arm is equal to a thickness of said ground electrode.

3. The spark plug of claim 1, wherein a thickness of said ground electrode pad is less than a thickness of said ground electrode.

4. The spark plug of claim 1, wherein the precious metal coating is an alloy containing iridium or platinum.

5. The spark plug of claim 1, wherein said ground electrode pad has a higher conductivity than said arm.

6. A ground electrode assembly for a spark plug comprising:

an arm having a first surface and a second surface opposite said first surface;

a ground electrode disposed on said arm, said ground electrode including a protrusion on said first surface of said arm and a recess on said second surface of said arm, a width of said protrusion being equal to a width of said recess; and a ground electrode pad disposed only on a surface of said protrusion, said ground electrode pad being a thermal coating.

7. The ground electrode assembly of claim 6, wherein a thickness of said arm is equal to a thickness of said ground electrode.

8. The ground electrode assembly of claim 6, wherein a thickness of said ground electrode pad is less than a thickness of said ground electrode.

9. The ground electrode assembly of claim 6, wherein said thermal coating is a precious metal coating containing iridium or platinum.

10. The ground electrode assembly of claim 6, wherein said ground electrode pad has a higher conductivity than said arm.

* * * * *